US006985047B2

(12) United States Patent
Brown et al.

(10) Patent No.: US 6,985,047 B2
(45) **Date of Patent: *Jan. 10, 2006**

(54) CONTINUOUSLY TUNABLE WAVEGUIDE ATTENUATOR

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/414,696

(22) Filed: Apr. 16, 2003

(65) Prior Publication Data

US 2004/0207481 A1 Oct. 21, 2004

(51) Int. Cl.
*H01P 1/22* (2006.01)

(52) U.S. Cl. ..... 333/81 B; 333/219.1; 333/209

(58) Field of Classification Search ..... 333/208–209, 333/219.1, 81 R, 81 B; 324/636; 327/308
See application file for complete search history.

(56) References Cited

U.S. PATENT DOCUMENTS

| | | | | |
|---|---|---|---|---|
| 3,701,058 | A | 10/1972 | Smith | |
| 4,260,967 | A | 4/1981 | Flieger | |
| 5,162,972 | A | 11/1992 | Gripshover et al. | |
| 5,260,665 | A * | 11/1993 | Goldberg et al. | 324/636 |
| 6,232,853 | B1 | 5/2001 | Goulouev | |
| 6,392,508 | B1 | 5/2002 | Damphousse et al. | |
| 6,480,078 | B2 * | 11/2002 | Kim et al. | 333/219.1 |
| 6,515,235 | B2 | 2/2003 | Moller | |
| 2004/0212449 | A1 * | 10/2004 | Rawnick et al. | 333/81 B |

FOREIGN PATENT DOCUMENTS

| | | | |
|---|---|---|---|
| JP | 361030801 A | * | 2/1986 |
| JP | 05-327401 | | 12/1993 |
| JP | 10-215140 | | 8/1998 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/387,194, filed Mar. 11, 2003, Brown et al.

(Continued)

*Primary Examiner*—Dinh T. Le
(74) *Attorney, Agent, or Firm*—Sacco & Associates, PA

(57) ABSTRACT

A continuously variable waveguide attenuator (100). The continuously variable waveguide attenuator includes at least one waveguide attenuator cavity (109) having at least one barrier. A fluid dielectric (108) having a loss tangent, a permittivity and a permeability is at least partially disposed within the waveguide attenuator cavity (109). At least one composition processor (101 ) is included and adapted for dynamically changing a composition of the fluid dielectric (108) to vary an electrical characteristic of the fluid dielectric. A controller (136) is provided for controlling the composition processor (101 ) to selectively vary the electrical characteristic in response to a waveguide attenuator control signal (137).

32 Claims, 3 Drawing Sheets

OTHER PUBLICATIONS

U.S. Appl. No. 10/438,435, filed May 15, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/300,455, filed Nov. 19, 2002, Brown et al.
Piloto, A.J., *Integrated Passive Components: A Brief Overview of LTCC Surface Mount and Integral Options,*, Kyocera America, San Diego, CA 92122.
K & L Microwave, Inc., *A Tunable, Dielectric-loaded Waveguide Filter, microwave Journal*, Aug., 1998. , <www.klmicrowave.com/news/articlearch/aug1998mj.htm >.
Sweeney, Dennis G., *Design and Construction of Waveguide Bandpass Filters,* Center for Wireless Telecommunications, Blacksburg, VA 24061.

* cited by examiner

CONTINUOUSLY TUNABLE WAVEGUIDE ATTENUATOR

BACKGROUND OF THE INVENTION

1. Statement of the Technical Field

The inventive arrangements relate generally to methods and apparatus for providing increased design flexibility for RF circuits, and more particularly to a waveguide attenuator.

2. Description of the Related Art

Variable waveguide attenuators are commonly used to attenuate microwave signals propagating within a waveguide, which is a type of transmission line structure commonly used for microwave signals. Waveguides typically consist of a hollow tube made of an electrically conductive material, for example copper, brass, steel, etc. Further, waveguides can be provided in a variety of shapes, but most often are cylindrical or have a rectangular cross section. In operation, waveguides propagate modes above a certain cutoff frequency.

Waveguide attenuators are available in a variety of arrangements. In one arrangement, the waveguide attenuator consists of three sections of waveguide in tandem: a middle section and two end sections. In each section a resistive film is placed across an inner diameter of the waveguide (in the case of a waveguide having a circular cross section) or across a width of the waveguide (in the case of a waveguide having a rectangular cross section). In either case, the resistive film collinearly extends the length of each waveguide section. The middle section of the waveguide is free to rotate radially with respect to the waveguide end sections. When the resistive film in the three sections are aligned, the E-field of an applied microwave signal is normal to all films. When this occurs, no current flows in the films and no attenuation occurs. When the center section is rotated at an angle $\theta$ with respect to the end section at the input of the waveguide, the E field can be considered to split into two orthogonal components, $E \sin \theta$ and $E \cos \theta$. $E \sin \theta$ is in the plane of the film and $E \cos \theta$ is orthogonal to the film. Accordingly, the $E \sin \theta$ component is absorbed by the film and the $E \cos \theta$ component is passed unattenuated to the end section at the output of the waveguide. The resistive film in the end section at the output then absorbs the $E \cos \theta \sin \theta$ component of the E field and an $E \cos^2 \theta$ component emerges from the waveguide at the same orientation as the original wave. The accuracy of such an attenuator is dependant on the stability of the resistive films. If the resistive films should degrade over time, performance of the waveguide attenuator will be affected. Further, energy reflections and higher-order mode propagation commonly occur in such a waveguide attenuator design.

In another arrangement, a wedge shaped waveguide attenuator having resistive surfaces is provided. Because the waveguide attenuator is wedge shaped, the E field again can be considered to split into two orthogonal components at each surface of the wedge, $E \sin \theta$ and $E \cos \theta$. As with the previous example, the $E \sin \theta$ component of a microwave signal is absorbed by the film. However, the tapered portion of the waveguide attenuator causes energy reflections to occur. Hence, the wedge shaped waveguide attenuator must be long enough to obtain sufficiently low reflection characteristics. Accordingly, this type of waveguide attenuator is limited to use in relatively long waveguides.

SUMMARY OF THE INVENTION

The present invention relates to a continuously variable waveguide attenuator. The continuously variable waveguide attenuator includes at least one waveguide attenuator cavity bounded by at least one barrier. A fluid dielectric having a loss tangent, a permittivity and a permeability is at least partially disposed within the waveguide attenuator cavity. The waveguide attenuator cavity can be, for example, wedge shaped. Further, a second waveguide attenuator cavity can be provided. A second fluid dielectric can be at least partially disposed within the second waveguide attenuator cavity.

At least one composition processor is included and adapted for dynamically changing a composition of the fluid dielectric to vary an electrical characteristic of the fluid dielectric, for example a loss tangent, a relative permittivity and/or a relative permeability. A controller is provided for controlling the composition processor to selectively vary the electrical characteristic in response to a waveguide attenuator control signal. The composition processor can selectively vary the electrical characteristic to vary the attenuation of the continuously variable waveguide attenuator or to maintain the attenuation constant when a second electrical characteristic of the fluid dielectric is varied.

A plurality of component parts can be dynamically mixed together in the composition processor in response to the waveguide attenuator control signal to form the fluid dielectric. The composition processor can include at least one proportional valve, at least one mixing pump, and at least one conduit for selectively mixing and communicating a plurality of the components of the fluid dielectric from respective fluid reservoirs to a waveguide attenuator cavity. The composition processor can further include a component part separator adapted for separating the component parts of the fluid dielectric for subsequent reuse.

The component parts can be selected from the group consisting of (a) a low permittivity, low permeability, low loss component and (b) a low permittivity, low permeability, high loss component. In another arrangement, the component parts can be selected from the group consisting of (a) a low permittivity, low permeability, low loss component, (b) a high permittivity, low permeability, low loss component, and (c) a low permittivity, high permeability, high loss component. In yet another arrangement, the component parts can be selected from (a) a low permittivity, low permeability, low loss component, (b) a high permittivity, low permeability, low loss component, (c) a high permittivity, high permeability, low loss component, and (d) a low permittivity, low permeability, high loss component.

The fluid dielectric can include an industrial solvent which can have a suspension of magnetic particles contained therein. The magnetic particles can consist of ferrite, metallic salts, and organo-metallic particles. In one arrangement, the variable waveguide attenuator can contain about 50% to 90% magnetic particles by weight although systems containing little or no magnetic particles can also be envisioned and the examples given herein should not limit the claims.

DETAILED DESCRIPTION OF THE PREFERRED EMBODIMENTS

The present invention provides the circuit designer with an added level of flexibility by permitting a fluid dielectric to be used in a waveguide attenuator, thereby enabling attenuation and impedance characteristics of the waveguide attenuator to be varied by varying electrical characteristics of the fluid dielectric. For example, either particles or fluids having a high loss tangent can be mixed into a fluid dielectric having a low to moderate loss tangent and the mixture ratio can be adjusted to vary the attenuation. The composition of the fluid dielectric can be adjusted to change the impedance of the waveguide attenuator or to maintain a constant impedance as the loss tangent of the dielectric fluid is adjusted. For example, the impedance of the waveguide attenuator can be precisely matched to the impedance of a waveguide by maintaining a constant ratio of relative permittivity ($\epsilon_r$) to relative permeability ($\mu_r$) in the fluid dielectric. A precisely matched impedance can minimize energy reflections caused by a transition from an unattenuated portion of the waveguide to the waveguide attenuator. A precisely matched impedance also reduces higher-order mode propagation.

Figure 1:
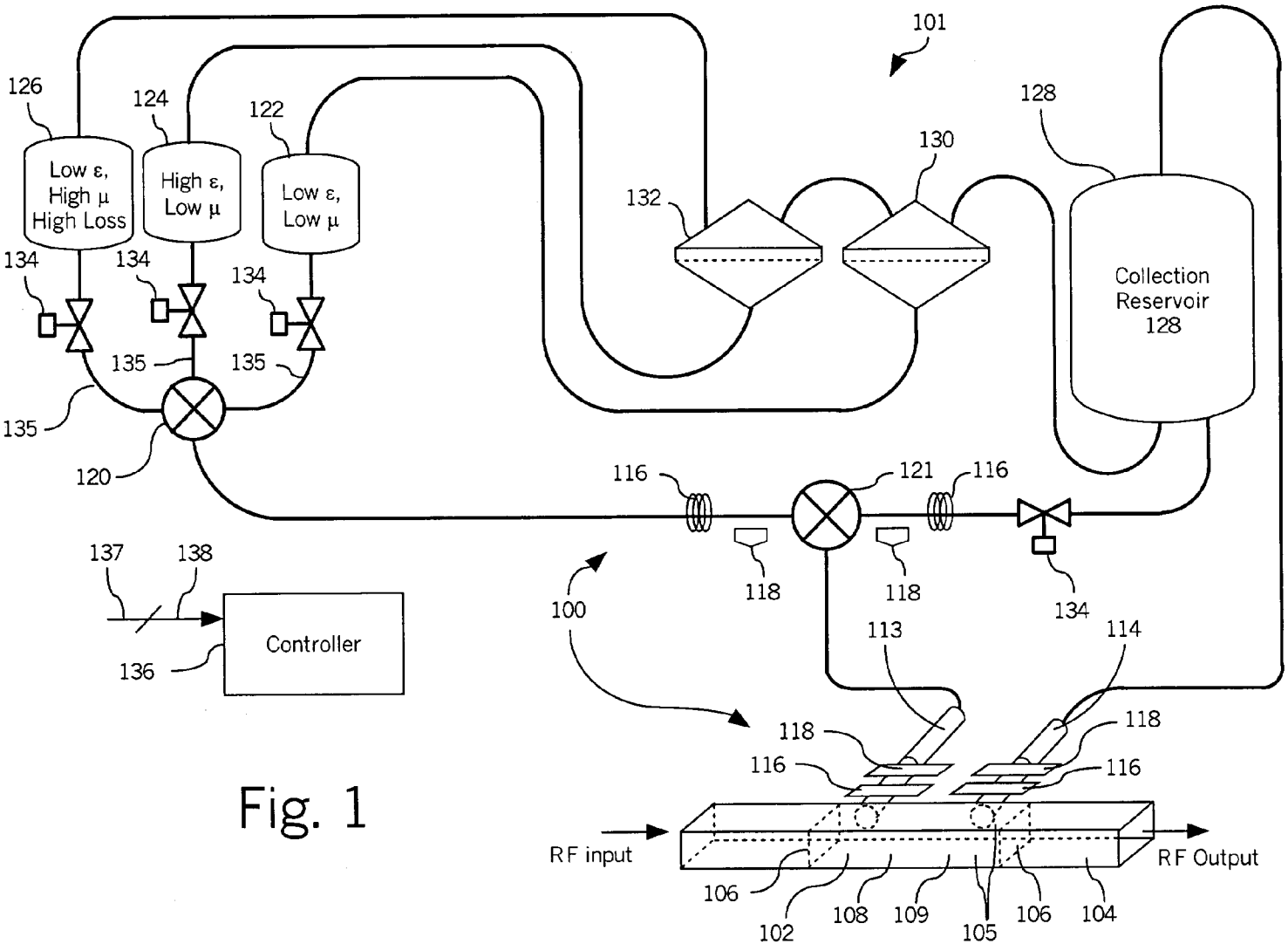
FIG. 1 is a block diagram useful for understanding the variable waveguide attenuator of the present invention.

FIG. 1 is a conceptual diagram that is useful for understanding the continuously variable waveguide attenuator 104 of the present invention. An attenuator apparatus 100 is provided to vary the characteristics of the waveguide attenuator 102, which comprises an attenuator cavity region 109 contained within a waveguide 104. The cavity region 109 is filled with a fluid dielectric 108 to vary attenuation characteristics, permittivity and/or permeability of the waveguide attenuator 102. The waveguide 104 can be any structure capable of supporting propagation modes. Waveguides are commonly embodied as electrically conductive tubes having circular or rectangular cross sections, but the present invention is not so limited; the present invention can be incorporated into any type of waveguide having any desired shape. For example, the present invention can be incorporated into a waveguide comprising circuit traces on a dielectric substrate and a plurality of rows of conductive vias which cooperatively support propagation modes. In such an example, at least one cavity for containing fluid dielectric can be positioned between adjacent rows of conductive vias. Additional vias having one end which couples to the cavity be provided as a pathway for the flow of fluid dielectric in and out of the cavity. Further, the waveguide attenuator 102 can be located anywhere within the waveguide 104. For example, the waveguide attenuator 102 can be located in a central location within the waveguide 104 at either end of the waveguide 104, or anywhere in between.

Although the shape of the waveguide attenuator 102 is primarily controlled by the shape of the cavity region 109, the waveguide attenuator 102 can incorporate other objects which protrude within the cavity 109. For example, tuning screws can protrude into the cavity region 109 to vary RF propagation characteristics within the cavity. Further, the cavity region 109 can comprise adjustable barriers and/or other objects which can change the RF response of the waveguide attenuator 102. In particular, changing the dimensions of the cavity region 109 can change the frequency of modes supported within cavity region 109.

Notably, the waveguide attenuator 102 can be provided in a variety of shapes. For example, the waveguide attenuator can be bounded on four sides by the walls 105 of the waveguide 104 and bounded on two sides by barriers 106. Preferably, the barriers are made of a dielectric material so as not to disrupt waveguide performance. In one arrangement, the waveguide attenuator 102 can be bounded by four dielectric barriers. In such an arrangement the waveguide attenuator 102 can be modular component that can be inserted into a waveguide.

Figure 2A:
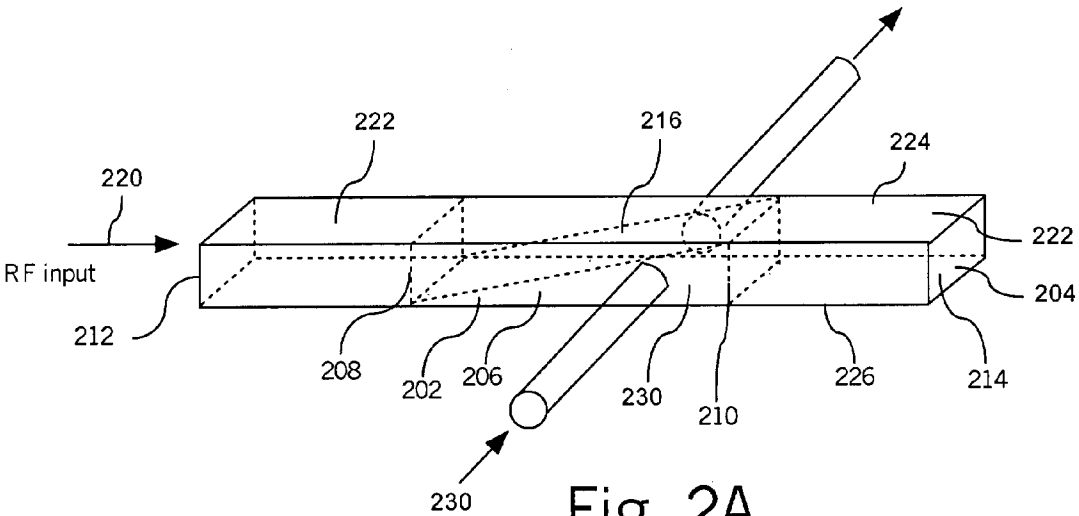
FIG. 2A is a perspective view of a waveguide attenuator having an alternate shape in accordance with the present invention.

The cavity 109 also can be arranged in complex shapes, for example a wedge shape. A wedge shape, as shown in FIG. 2A, can be particularly useful to minimize reflection of an RF signal 220 due to the waveguide attenuator 202, for example, when there is an impedance mismatch between the waveguide attenuator 202 and the remaining dielectric 222 within a waveguide 204. Such an impedance mismatch can occur when the waveguide attenuator 202 has a different characteristic impedance than the remaining dielectric 222. The waveguide attenuator 202 can be positioned with a narrow end 208 oriented towards an end 212 of the waveguide 204 receiving RF input 220 and a wide end 210 of the waveguide attenuator 202 towards an output end 214 of the waveguide 204. Since there is a large angle of incidence between the RF signal 220 and a diagonal barrier 216, very little signal energy will be reflected towards the input end 212. Further, since the depth of the waveguide cavity 206 varies along the length of the waveguide attenuator 202, the amount of lossy fluid dielectric 230 between opposing waveguide walls 224 and 226 will vary. Accordingly, the attenuation of the waveguide attenuator 202 will vary over its length. The change in attenuation should be taken into consideration when computing the overall net attenuation of the waveguide attenuator 202.

Figure 2B:
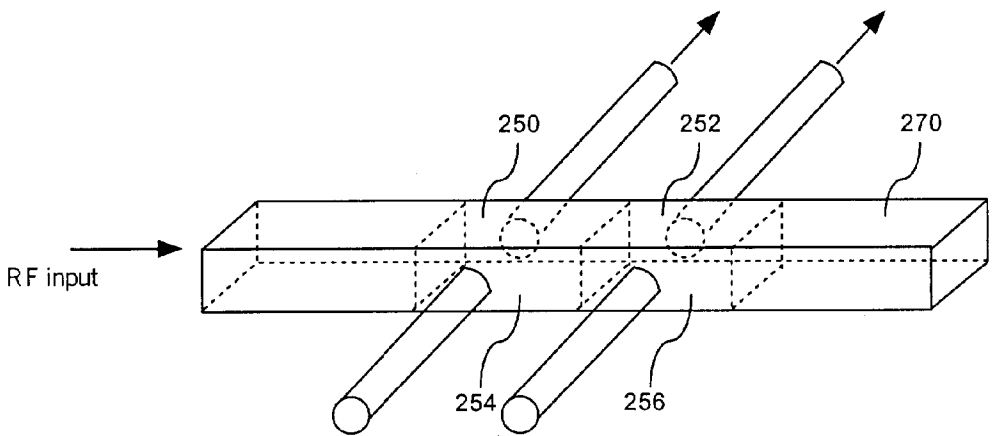
FIG. 2B is a perspective view of a waveguide having multiple waveguide attenuators in accordance with the present invention.

Further, multiple waveguide attenuators 250, 252 can be included in a single waveguide, for instance, to provide a greater range of attenuation adjustment. Referring to FIG. 2B, one arrangement can be provided wherein a waveguide 270 is provided with cascaded waveguide attenuator cavities 254, 256. The waveguide attenuator cavities 254, 256 can be separately filled with fluid dielectric to achieve wider ranges of attenuation adjustment than might be achieved by merely varying the fluid dielectric in a single cavity. For instance, a first waveguide attenuator cavity 254 can be at least partially filled with a fluid dielectric 260 to provide a first range of attenuation levels, for example 0–10 dB. If greater attenuation is required, then a second waveguide attenuator cavity 256 can be at least partially filled with a second fluid dielectric 262. A valve (not shown) can be used to fill and evacuate the fluid dielectric 260, 262 from the waveguide attenuator cavities 254, 256 as required. If each waveguide attenuator provides an attenuation range of 0–10 dB and 18 dB of attenuation is needed, the first waveguide attenuator cavity can be filled with a first fluid dielectric 260 and adjusted to provide 10 dB of attenuation while the second waveguide attenuator cavity is filled with a second fluid dielectric 262 and adjusted to provide 8 dB of attenuation. In this arrangement, additional fluid composition processors can be provided to individually adjust the fluid dielectric for each waveguide attenuator cavity 254, 256. Alternatively, each of the waveguide attenuator cavities 254, 256 can be adjusted to have an equal attenuation, for example 9 dB each. In such an arrangement the waveguide attenuator cavities can share a fluid dielectric from a common fluid composition processor. Still, a myriad of combinations of waveguide attenuator cavities and attenuation levels can be used, any of which are within the scope of the present invention. In particular, each waveguide attenuator can provide greater or smaller attenuation ranges. For example, each waveguide attenuator can provide 0–5 dB, 0–20 db, 0–50 dB or 0–100 dB of attenuation. Further, any number of waveguide attenuators can be cascade.

Referring again to FIG. 1, a composition processor 101 is provided for changing a composition of the fluid dielectric 108 to vary the attenuation characteristics of the fluid dielectric. Further, it is preferable that the composition processor 101 also change the composition of the fluid dielectric 108 to vary permittivity and/or permeability in order to maintain control over the characteristic impedance of the waveguide attenuator 102. A controller 136 controls the composition processor for selectively varying the attenuation, permittivity and/or permeability of the fluid dielectric 108 in response to a waveguide attenuator control signal 137. By selectively varying the attenuation, permittivity and/or permeability of the fluid dielectric, the controller 136 can control attenuation of an RF signal, for example a microwave signal, through the waveguide 104 as well as group velocity of the RF signal. Further, the controller 136 can control the impedance of the waveguide 104 within the cavity region 109.

Composition of Fluid Dielectric

The fluid dielectric can be comprised of several component parts that can be mixed together to produce a desired attenuation, permittivity and permeability required for particular waveguide attenuator characteristics. In this regard, it will be readily appreciated that fluid miscibility and particle suspension are key considerations to ensure proper mixing. Another key consideration is the relative ease by which the component parts can be subsequently separated from one another. The ability to separate the component parts is important when the attenuation or impedance requirements change. Specifically, this feature ensures that the component parts can be subsequently re-mixed in a different proportion to form a new fluid dielectric.

It may be desirable in many instances to select component mixtures that produce a fluid dielectric that has a relatively constant response over a broad range of frequencies. If the fluid dielectric is not relatively constant over a broad range of frequencies, the characteristics of the fluid at various frequencies can be accounted for when the fluid dielectric is mixed. For example, a table of loss tangent, permittivity and permeability values vs. frequency can be stored in the controller 136 for reference during the mixing process.

Aside from the foregoing constraints, there are relatively few limits on the range of component parts that can be used to form the fluid dielectric. Accordingly, those skilled in the art will recognize that the examples of component parts, mixing methods and separation methods as shall be disclosed herein are merely by way of example and are not intended to limit in any way the scope of the invention. Also, the component materials are described herein as being mixed in order to produce the fluid dielectric. However, it should be noted that the invention is not so limited. Instead, it should be recognized that the composition of the fluid dielectric could be modified in other ways. For example, the component parts could be selected to chemically react with one another in such a way as to produce the fluid dielectric with the desired values of permittivity and/or permeability. All such techniques will be understood to be included to the extent that it is stated that the composition of the fluid dielectric is changed.

A nominal value of permittivity ($\epsilon_r$) for fluids is approximately 2.0. However, the component parts for the fluid dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluid dielectric with a permittivity anywhere within that range after mixing. Dielectric particle suspensions can also be used to increase permittivity and loss tangent.

According to a preferred embodiment, the component parts of the fluid dielectric can be selected to include (a) a low permittivity, low permeability, low loss component and (b) a low permittivity, low permeability, high loss component. These two components can be mixed as needed for increasing the loss tangent while maintaining a relatively constant ratio of permittivity to permeability. Still, a myriad of other component mixtures can be used. For example, the component parts of the fluid dielectric can be selected to include (a) a low permittivity, low permeability, low loss component and (b) a high permittivity, high permeability, high loss component. A third component part of the fluid dielectric can include (c) a high permittivity, low permeability, low loss component for allowing adjustment of the permittivity of the fluid dielectric independent of the permeability. Another possible list of fluid dielectric component parts can include (a) a low permittivity, low permeability, low loss component, (b) a high permittivity, low permeability, low loss component, (c) a high permittivity, high permeability low loss component, and (d) a low permittivity, low permeability, high loss component.

In yet another example, the following fluid dielectric components can be provided: (a) a low permittivity, low permeability, low loss component, (b) a high permittivity, low permeability, low loss component, and (c) a low permittivity, high permeability, high loss component. An example of a set of component parts that could be used to produce such a fluid dielectric could include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the fluid dielectric, for example those commercially available from FerroTec Corporation of Nashua, N.H. 03060. In particular, Ferrotec part numbers EMG0805, EMG0807, and EMG1111 can be used. These fluids each exhibit a loss tangent approximately 10 to 100 times that of air. MRF-132AD is another fluid that can be used to introduce a loss tangent. MRF-132AD is commercially available from Lord Corporation of Cary, N.C. and has loss tangent approximately several times that of a low loss fluid. Further, the fluid has a dielectric constant between 5 and 6.

Lossy particles, for example magnetic metals such as ferrite (Fe) powder or cobalt (Co) powder, also can be mixed into the fluid dielectric to increase the loss tangent of the fluid dielectric. Both Fe and Co are available as micron-sized particles suitable for use in suspensions. Particles sizes in the range of 1 nm to 20 $\mu$m are common. Solid alloys of these materials can exhibit levels of $\mu_r$ in excess of one thousand. Accordingly, high permeability can be achieved in a fluid by introducing metal particles/elements to the fluid. For example, ferro-magnetic particles can be mixed in a conventional industrial solvent such as water, toluene, mineral oil, silicone, and or any other suitable fluid to create a particle suspension within the fluid. Other types of magnetic particles which can be used to create a particle suspension within a fluid include metallic salts, organo-metallic compounds, and other derivatives, although Fe and Co particles are most common. The composition of particles can be varied as necessary to achieve the required range of permeability in the final mixed fluid dielectric after mixing. However, magnetic fluid compositions are typically between about 50% to 90% particles by weight. Increasing the number of particles will generally increase the permeability.

A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetorestrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid permittivity also can be increased by adding high permittivity powders such as Barium Titanate manufactured by Ferro Corporation of Cleveland, Ohio. For broadband applications, the fluids would not have significant resonances over the frequency band of interest.

Processing of Fluid Dielectric For Mixing/Unmixing of Components

The composition processor 101 can be comprised of a plurality of fluid reservoirs containing component parts of fluid dielectric 108. These can include: a first fluid reservoir 122 for a low permittivity, low permeability component of the fluid dielectric; a second fluid reservoir 124 for a high permittivity, low permeability component of the fluid dielectric; a third fluid reservoir 126 for a low permittivity, high permeability, high loss component of the fluid dielectric. Those skilled in the art will appreciate that other combinations of component parts may also be suitable and the invention is not intended to be limited to the specific combination of component parts described herein. For example, the third fluid reservoir 126 can contain a low permittivity, high permeability, low loss component of the fluid dielectric and a fourth fluid reservoir can be provided to contain a component of the fluid dielectric having a high loss tangent.

A cooperating set of proportional valves 134, mixing pumps 120,121, and connecting conduits 135 can be provided as shown in FIG. 1 for selectively mixing and communicating the components of the fluid dielectric 108 from the fluid reservoirs 122, 124, 126 to cavity 109. The composition processor also serves to separate out the component parts of fluid dielectric 108 so that they can be subsequently re-used to form the fluid dielectric with different attenuation, permittivity and/or permeability values. All of the various operating functions of the composition processor can be controlled by controller 136. The operation of the composition processor shall now be described in greater detail with reference to FIG. 1 and the flowchart shown in FIG. 3.

Figure 3:
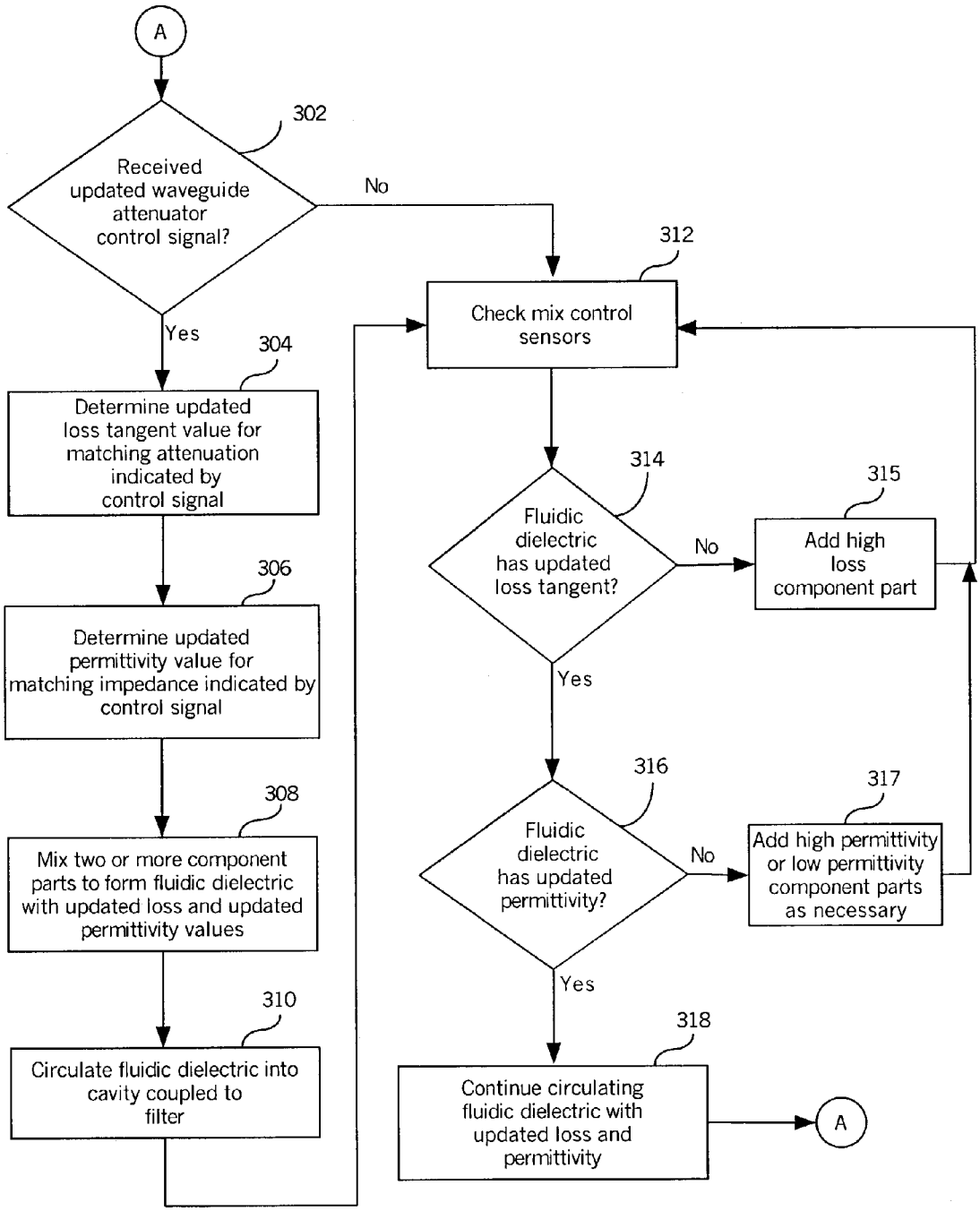
FIG. 3 is a flow chart that is useful for understanding the process of the invention.

The process can begin in step 302 of FIG. 3, with controller 136 checking to see if an updated waveguide attenuator control signal 137 has been received on an attenuator input line 138. If so, then the controller 136 continues on to step 304 to determine an updated loss tangent value for producing the attenuation indicated by the waveguide attenuator control signal 137. The updated loss tangent value necessary for achieving the indicated attenuation can be determined using a look-up table.

In step 306, the controller can determine an updated permittivity value for matching the characteristic impedance indicated by the waveguide attenuator control signal 137. For example, the controller 136 can determine the permeability of the fluid components based upon the fluid component mix ratios and determine an amount of permittivity that is necessary to achieve the indicated impedance for the determined permeability.

Referring to step 308, the controller 136 causes the composition processor 101 to begin mixing two or more component parts in a proportion to form fluid dielectric that has the updated loss tangent and permittivity values determined earlier. In the case that the high loss component part also provides a substantial portion of the permeability in the fluid dielectric, the permeability will be a function of the amount of high loss component part that is required to achieve a specific attenuation. However, in the case that a separate high permeability fluid is provided as a high permeability component part, the permeability can be determined independently of the loss tangent. This mixing process can be accomplished by any suitable means. For example, in FIG. 1 a set of proportional valves 134 and mixing pump 120 are used to mix component parts from reservoirs 122, 124, 126 appropriate to achieve the desired updated loss tangent, permittivity and permeability values.

In step 310, the controller causes the newly mixed fluid dielectric 108 to be circulated into the cavity 109 through a second mixing pump 121. In step 312, the controller checks one or more sensors 116, 118 to determine if the fluid dielectric being circulated through the cavity 109 has the proper values of loss tangent, permittivity and permeability. Sensors 116 are preferably inductive type sensors capable of measuring permeability. Sensors 118 are preferably capacitive type sensors capable of measuring permittivity. Further, sensors 116 and 118 can be used in conjunction to measure loss tangent since the loss tangent is the ratio between the real and imaginary parts of an impedance measurement. The impedance can be determined from resistance (R), conductance (G), inductance (L) and capacitance (C) measurements. Additionally, the loss tangent can be easily calculated using a separate resonator device, such as a dielectric ring resonator. Such resonator devices are commonly used to compute the quality factor, Q, from which loss tangent can be easily extracted.

The sensors can be located as shown, at the input to mixing pump 121. Sensors 116, 118 are also preferably positioned to measure the loss tangent, permittivity and permeability of the fluid dielectric passing through input conduit 113 and output conduit 114. Note that it is desirable to have a second set of sensors 116, 118 at or near the cavity 109 so that the controller can determine when the fluid dielectric with updated loss tangent, permittivity and permeability values has completely replaced any previously used fluid dielectric that may have been present in the cavity 109.

In step 314, the controller 136 compares the measured loss tangent to the desired updated loss tangent value determined in step 304. If the fluid dielectric does not have the proper updated loss tangent value, the controller 136 can cause additional amounts of high loss tangent component part to be added to the mix from reservoir 126, as shown in step 315.

If the fluid dielectric is determined to have the proper level of loss in step 314, then the process continues on to step 316 where the measured permittivity from step 312 is compared to the desired updated permittivity value determined in step 306. If the updated permittivity value has not been achieved, then high or low permittivity component parts are added as necessary, as shown in step 317. The system can continue circulating the fluid dielectric through the cavity 109 until both the loss tangent and permittivity passing into and out of the cavity 109 are the proper value, as shown in step 318. Once the loss tangent and permittivity are the proper value, the process can continue to step 302 to wait for the next updated waveguide attenuator control signal.

Significantly, when updated fluid dielectric is required, any existing fluid dielectric must be circulated out of the cavity 109. Any existing fluid dielectric not having the proper loss tangent and/or permittivity can be deposited in a collection reservoir 128. The fluid dielectric deposited in the collection reservoir can thereafter be re-used directly as a fourth fluid by mixing with the first, second and third fluids or separated out into its component parts so that it may be re-used at a later time to produce additional fluid dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir.

Those skilled in the art will recognize that the specific process used to separate the component parts from one another will depend largely upon the properties of materials that are selected and the invention. Accordingly, the invention is not intended to be limited to the particular process outlined above.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A continuously variable waveguide attenuator, comprising;

at least one waveguide attenuator cavity bounded by at least one barrier, at least a portion of said barrier being a dielectric material;

a fluid dielectric at least partially disposed within said waveguide attenuator cavity;

at least one composition processor adapted for dynamically changing a composition of said fluid dielectric to vary at least one electrical characteristic of said fluid dielectric; and a controller for controlling said composition processor to selectively vary said electrical characteristic in response to a waveguide attenuator control signal.

2. The continuously variable waveguide attenuator according to claim 1 wherein said electrical characteristic is selected from the group consisting of the loss tangent, a relative permittivity and a relative permeability.

3. The continuously variable waveguide attenuator according to claim 1 wherein the waveguide attenuator has an attenuation and said composition processor selectively varies said at least one electrical characteristic to vary said attenuation.

4. The continuously variable waveguide attenuator according to claim 1 wherein the waveguide attenuator has an attenuation and said composition processor selectively varies said at least one electrical characteristic to maintain said attenuation constant as a second electrical characteristic of said fluid dielectric is varied.

5. The continuously variable waveguide attenuator according to claim 1 wherein the waveguide attenuator has a characteristic impedance and said composition processor selectively varies said at least one electrical characteristic to adjust said characteristic impedance.

6. The continuously variable waveguide attenuator according to claim 1 wherein a plurality of component parts are dynamically mixed together in said composition processor responsive to said waveguide attenuator control signal to form said fluid dielectric.

7. The continuously variable waveguide attenuator according to claim 6 wherein said composition processor further comprises a component part separator adapted for separating said component parts of said fluid dielectric for subsequent reuse.

8. The continuously variable waveguide attenuator according to claim 6 wherein said component parts are selected from the group consisting of (a) a low permittivity, low permeability, low loss component and (b) a low permittivity, low permeability, high loss component.

9. The continuously variable waveguide attenuator according to claim 6 wherein said component parts are selected from the group consisting of (a) a low permittivity, low permeability, low loss component, (b) a high permittivity, low permeability, low loss component, and (c) a low permittivity, high permeability, high loss component.

10. The continuously variable waveguide attenuator according to claim 6 wherein said component parts are selected from the group consisting of (a) a low permittivity, low permeability, low loss component, (b) a high permittivity, low permeability, low loss component, (c) a high permittivity, high permeability, low loss component, and (d) a low permittivity, low permeability, high loss component.

11. The continuously variable waveguide attenuator according to claim 1 wherein said composition processor further comprises at least one proportional valve, at least one mixing pump, and at least one conduit for selectively mixing and communicating a plurality of said components of said fluid dielectric from respective fluid reservoirs to a waveguide attenuator cavity.

12. The continuously variable waveguide attenuator according to claim 1 wherein said fluid dielectric is comprised of an industrial solvent.

13. The continuously variable waveguide attenuator according to claim 12 wherein said industrial solvent has a suspension of magnetic particles contained therein.

14. The continuously variable waveguide attenuator according to claim 13 wherein said magnetic particles are formed of a material selected from the group consisting of ferrite, metallic salts, and organo-metallic particles.

15. The continuously variable waveguide attenuator according to claim 13 wherein said component contains between about 50% to 90% magnetic particles by weight.

16. The continuously variable waveguide attenuator according to claim 1, further comprising a second waveguide attenuator cavity bounded by at least one barrier, at least a portion of said barrier of said second waveguide attenuator being a dielectric material.

17. The continuously variable waveguide attenuator according to claim 16, wherein a second fluid dielectric is disposed in said second waveguide attenuator cavity.

18. The continuously variable waveguide attenuator according to claim 17, further comprising at least a second composition processor adapted for dynamically changing a composition of said second fluid dielectric to vary at least one electrical characteristic of said second fluid dielectric.

19. The continuously variable waveguide attenuator according to claim 1, wherein said waveguide attenuator cavity is wedge shaped.

20. A method for controlling an attenuation of a waveguide attenuator comprising the steps of:

providing at least one waveguide attenuator cavity within a waveguide;

disposing a fluid dielectric within said at least one waveguide attenuator cavity;

responsive to a control signal, selectively varying at least a first electrical characteristic of said fluid dielectric to selectively control an attenuation of an RF signal propagated along said waveguide; and varying said first electrical characteristic to maintain said attenuation constant as a second electrical characteristic of said fluid dielectric is varied.

21. A method for controlling an attenuation of a waveguide attenuator comprising the steps of:

providing at feast one waveguide attenuator cavity within a waveguide;

disposing a fluid dielectric within said at least one waveguide attenuator cavity;

responsive to a control signal, selectively varying at least one electrical characteristic of said fluid dielectric to selectively control an attenuation of an RF signal propagated along said waveguide; and dynamically mixing a plurality of components in response to said control signal to selectively vary said at least one electrical characteristic of said fluid dielectric.

22. The method according to claim 21 further comprising the step of separating said plurality of components after said dynamically mixing for subsequent reuse in selectively varying said at least one electrical characteristic of said fluid dielectric.

23. The continuously variable waveguide attenuator according to claim 21 wherein said plurality of components are selected from the group consisting of (a) a low permittivity, low permeability, low loss component and (b) a low permittivity, low permeability, high loss component.

24. The continuously variable waveguide attenuator according to claim 21 wherein said plurality of components are selected from the group consisting of (a) a low permittivity, low permeability, low loss component, (b) a high permittivity, low permeability, low loss component, and (c) a low permittivity, high permeability, high loss component.

25. The continuously variable waveguide attenuator according to claim 21 wherein said plurality of components are selected from the group consisting of (a) a low permittivity, low permeability, low loss component, (b) a high permittivity, low permeability, low loss component, (c) a high permittivity, high permeability, low loss component, and (d) a low permittivity, low permeability, high loss component.

26. The method according to claim 21 further comprising the step of selectively extracting said plurality of components of said fluid dielectric from respective fluid reservoirs.

27. The method according to claim 21 further comprising the step of selecting at least one of said plurality of components of said fluid dielectric to include an industrial solvent.

28. The method according to claim 21 further comprising the step of selecting at least one of said plurality of components of said fluid dielectric to include an industrial solvent that has a suspension of magnetic particles contained therein.

29. The method according to claim 28 further comprising the step of selecting a material for said magnetic particles from the group consisting of a ferrite, metallic salts, and organo-metallic particles.

30. The method according to claim 28 further comprising the step of selecting said component to include about 50% to 90% magnetic particles by weight.

31. A method for controlling an attenuation of a waveguide attenuator comprising the steps of: providing a plurality of waveguide attenuator cavities within a waveguide;

disposing a first fluid dielectric within at least a first one of said plurality of waveguide attenuator cavities;

responsive to a control signal, selectively varying at least one electrical characteristic of said first fluid dielectric to selectively control an attenuation of an RF signal propagated along said waveguide; and disposing a second fluid dielectric within at least a second one of said plurality of waveguide attenuator cavities.

32. The method according to claim 31, further comprising the step of dynamically changing a composition of said second fluid dielectric to vary at least one electrical characteristic of said second fluid dielectric.

* * * * *